US005426295A

United States Patent [19]

Parikh et al.

[11] Patent Number: 5,426,295

[45] Date of Patent: Jun. 20, 1995

[54] MULTIPLE INTEGRATED LASER ENGAGEMENT SYSTEM EMPLOYING FIBER OPTIC DETECTION SIGNAL TRANSMISSION

[75] Inventors: Himanshu N. Parikh, San Diego; Fritz W. Healey, Carlsbad, both of Calif.

[73] Assignee: Cubic Defense Systems, Inc., San Diego, Calif.

[21] Appl. No.: 235,296

[22] Filed: Apr. 29, 1994

[51] Int. Cl.[6] ..... H01J 5/16

[52] U.S. Cl. ..... 250/227.1; 250/551; 434/22

[58] Field of Search ..... 250/551, 227.11; 434/21, 22, 23; 273/310, 311, 312

[56] References Cited

U.S. PATENT DOCUMENTS

| | | | |
|---|---|---|---|
| 3,790,791 | 2/1974 | Anderson | 250/227 |
| 4,063,368 | 12/1977 | McFarland et al. | 35/25 |
| 4,352,665 | 10/1982 | Kimble et al. | 434/22 |
| 4,487,583 | 12/1984 | Brueker et al. | 434/22 |
| 4,629,427 | 12/1986 | Gallagher | 434/22 |
| 4,695,058 | 9/1987 | Carter, III et al. | 273/311 |
| 4,712,885 | 12/1987 | Dawson et al. | 350/443 |
| 4,899,039 | 2/1990 | Taylor et al. | 250/209 |
| 4,973,952 | 11/1990 | Malec et al. | 340/825.35 |
| 5,012,097 | 4/1991 | Oda | 250/336.1 |
| 5,292,254 | 3/1994 | Miller et al. | 434/11 |

OTHER PUBLICATIONS

MILES Trainer Engineering Report, vol. I, Xerox Electro-Optical Systems, Apr. 22, 1981.

*Primary Examiner*—David C. Nelms
*Assistant Examiner*—Steven L. Nichols
*Attorney, Agent, or Firm*—Baker, Maxham, Jester & Meador

[57] ABSTRACT

A manworn laser detection system is provided for use in a multiple integrated laser engagement system (MILES). A plurality of laser detectors are carried by a harness adapted to be worn by a person for receiving a laser bullet hit from a weapon equipped with a laser small arms transmitter (SAT). An amplifier on the harness is connected to the laser detectors on the harness for amplifying a first electrical output signal of the laser detectors. A first optical coupling on the harness is connected to the amplifier for emitting optical signals representative of the amplified first electrical output signal of the laser detectors. An electronics assembly is adapted to be carried by the person and includes second optical coupling adapted to be mated with the first optical coupling for receiving the optical signals and generating a second electrical output signal representative thereof. A controller in the electronics assembly is provided for decoding a MILES code embedded in the second electrical output signal. The electronics assembly also includes a display and/or audio output device for providing an indication to the person of the decoded output signal. This indication may be the fact that the person has been "hit", the player identification of the person that fired a SAT equipped weapon, and the type of weapon that scored the hit.

20 Claims, 5 Drawing Sheets

MULTIPLE INTEGRATED LASER ENGAGEMENT SYSTEM EMPLOYING FIBER OPTIC DETECTION SIGNAL TRANSMISSION

BACKGROUND OF THE INVENTION

The present invention relates to military training equipment, and more particularly, to an improved system for detecting, communicating and processing laser simulated weapon hits on soldiers and paramilitary personnel.

For many years the armed services of the United States have trained soldiers with a multiple integrated laser engagement system (MILES). A laser small arms transmitter (SAT) is mounted to a rifle stock. Each soldier carries optical detectors on his or her helmet and on a body harness adapted to detect a laser "bullet" hit. The soldier pulls the trigger of the rifle to fire a blank cartridge to simulate the firing of an actual round and a sensor on the SAT triggers the laser. The player identification and weapon type can be encoded on the laser beam using a MILES code. An electronic controller also carried by the soldier is connected through an amplifier to the optical detectors to decode the output signals thereof and provide an indication to the soldier that he or she has been hit by a laser bullet.

The high gain amplifier of the conventional "manworn" portion of the MILES is contained within the same housing as the controller. The amplifier is extremely sensitive to electrical noise generated by the controller. Too high of a gain on this amplifier can result in false hits being indicated by the controller. Too low of a gain of this amplifier can result in a failure to detect a hit by a laser bullet. At present it is difficult to check for problems in the amplifier.

It is currently necessary to make a physical electrical connection in order to download data from the conventional "manworn" portion of the MILES. This is time consuming and the connectors can become damaged during the rigorous physical conditions encountered in war games.

The conventional manworn portion of the MILES uses a hardware shift register to decode the received laser. This hard-wired logic circuitry is inadequate in decoding the received laser signal if portions of that signal are lost. This aspect of the conventional manworn portion of the MILES also makes it impossible to change or modify the code structure being transmitted by the laser beam from the SAT without changing the circuitry in the manworn controller.

SUMMARY OF THE INVENTION

It is therefore the primary object of the present invention to provide an improved manworn portion of a multiple integrated laser engagement system (MILES).

The present invention provides a manworn laser detection system for use in a multiple integrated laser engagement system (MILES). A plurality of laser detectors are carried by a harness adapted to be worn by a person for receiving a laser bullet hit from a weapon equipped with a laser small arms transmitter (SAT). An amplifier on the harness is connected to the laser detectors on the harness for amplifying a first electrical output signal of the laser detectors. A first optical coupling on the harness is connected to the amplifier for emitting optical signals representative of the amplified first electrical output signal of the laser detectors. An electronics assembly is adapted to be carried by the person and includes second optical coupling adapted to be mated with the first optical coupling for receiving the optical signals and generating a second electrical output signal representative thereof. A controller in the electronics assembly is provided for decoding a MILES code embedded in the second electrical output signal. The electronics assembly also includes a display and/or audio output device for providing an indication to the person of the decoded output signal. This indication may be the fact that the person has been "hit", the player identification of the person that fired a SAT equipped weapon, and the type of weapon that scored the hit.

BRIEF DESCRIPTION OF THE DRAWINGS

Throughout the drawing figures like reference numerals refer to like parts.

DETAILED DESCRIPTION OF THE PREFERRED EMBODIMENT

Figure 1:
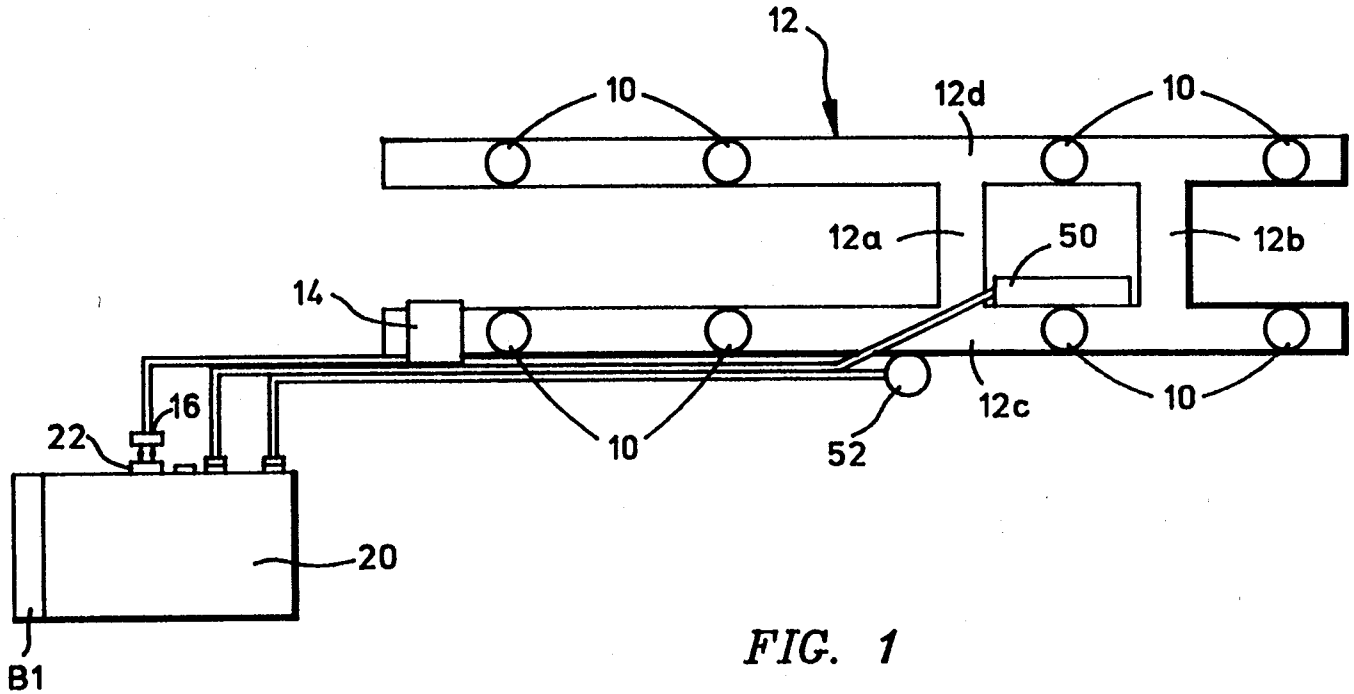
FIG. 1 is a plan view of the harness and coupled electronics assembly of a preferred embodiment of our manworn laser detection system for use in a multiple integrated laser engagement system (MILES).

FIG. 1 illustrates a preferred embodiment of our manworn laser detection system for use in a multiple integrated laser engagement system. A plurality of laser detectors 10 are carried by an H-shaped harness 12 adapted to be worn by a soldier or paramilitary person for receiving a laser bullet hit from a weapon equipped with a laser small arms transmitter (SAT). The harness is worn over the shoulders with the head between the two traverse sections 12*a* and 12*b* so as to place four of the detectors on the person's chest and four on the person's back. The ends of the two longitudinal sections 12*c* and 12*d* of the harness may be secured to a belt (not shown) that encircles the person's waist.

A separate amplifier assembly 14 (FIG. 1) is secured to one end of the harness section 12*c*. The amplifier assembly 14 includes a housing containing an amplifier circuit which is connected to the laser detectors 10 on the harness 12 for amplifying a first electrical output signal of the laser detectors 10. A first optical coupling 16 is connected to the amplifier assembly 14 via wires 38, 40, and functions to emit infrared optical signals representative of the amplified electrical output signal of the laser detectors 10.

An electronics assembly 20 (FIG. 1) is adapted to be carried by the person and includes second optical coupling 22 adapted to be mated with the first optical coupling 16. The second optical coupling 22 receives the infrared optical signals and generates a second electrical output signal representative thereof. The electronics assembly 20 includes a rectangular housing sized to attachment to the belt carried around the person's waist.

A controller 24 (FIG. 3) in the electronics assembly 20 is provided for decoding the second electrical output signal. The electronics assembly 20 also includes a display 26 on one end thereof for providing a visible indication to the person of the decoded output signal. The display may be an LCD type display that provides text messages. The visible indication of the decoded output signal may include the fact that the person has been "hit", the player identification of the person that fired a SAT equipped weapon, and the type of weapon that scored the hit. The electronics assembly 20 may use an audio indicator of the decoded output signal which may produce tones in lieu of, or in addition to, the display 26. For example, a buzzer may be energized when the person has been hit.

Figure 2:
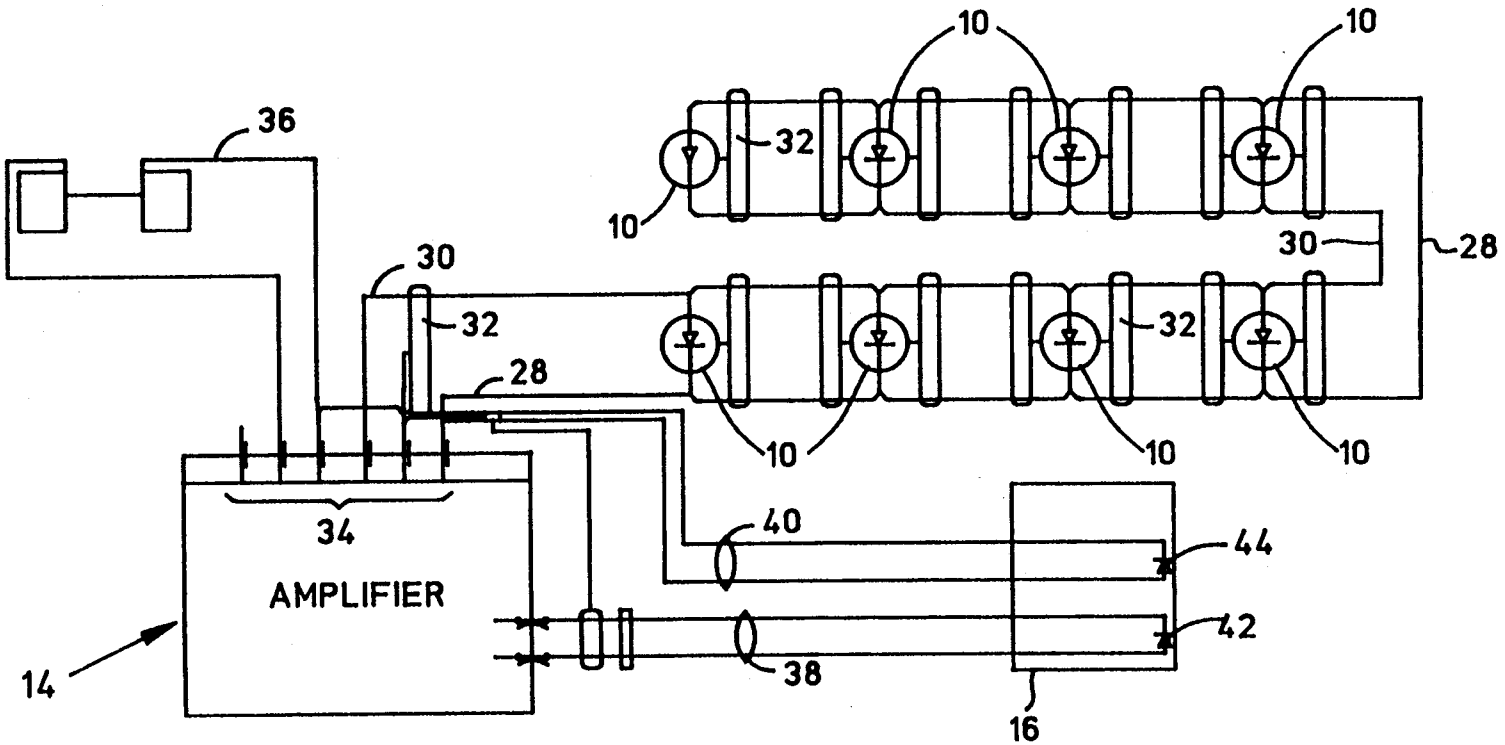
FIG. 2 is diagrammatic illustration showing details of the harness and the amplifier assembly of the system of FIG. 1.

FIG. 2 is diagrammatic illustration of the harness 12 and amplifier assembly 14 of the system of FIG. 1. The laser detectors 10 on the harness 12 are each solid state type devices with a large circular active face. They are connected in parallel by electrical conductors 28 and 30. The conductors 28 and 30 are held in position by spacer bars 32 secured to the two longitudinal sections 12*c* and 12*d* of the harness 12. The terminal ends of the conductors 28 and 30 are connected via terminal strip 34 to the amplifier assembly 14. An inductive loop pickup 36 is also connected to the amplifier assembly 14 via the terminal strip 34. The loop pickup 36 couples with an inductive loop transmitter (not visible) connected to four laser detectors (not shown) on the person's helmet. Twisted pairs of wires 38 and 40 connect the amplifier assembly 14 to IR emitter and detector diodes 42 and 44, respectively. The diodes 42 and 44 form the first optical coupling 16.

Figure 3:
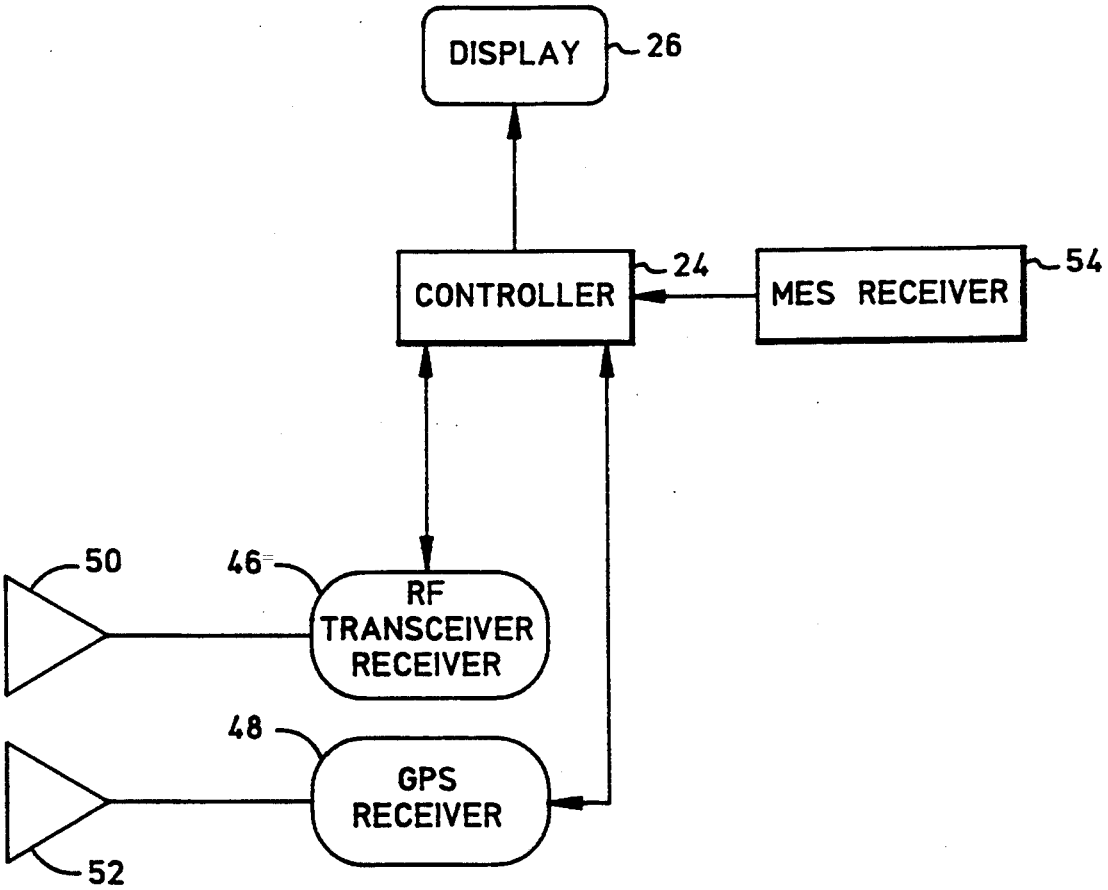
FIG. 3 is a block diagram of electronics assembly of the system of FIG. 1.

FIG. 3 is a block diagram of electronics assembly of the system of FIG. 1. The controller 24 is connected to an RF receiver/transceiver 46 and a GPS receiver 48. The inputs from these conventional devices are utilized to simulate indirect fire, such as from artillery as part of the overall operation of the MILES. Antennas 50 and 52 mounted to the harness 12 are connected to the RF receiver/transceiver 46 and the GPS receiver 48, respectively, to facilitate signal transmission and acquition. An MES receiver 54 is also connected to the controller 24.

Figure 4:
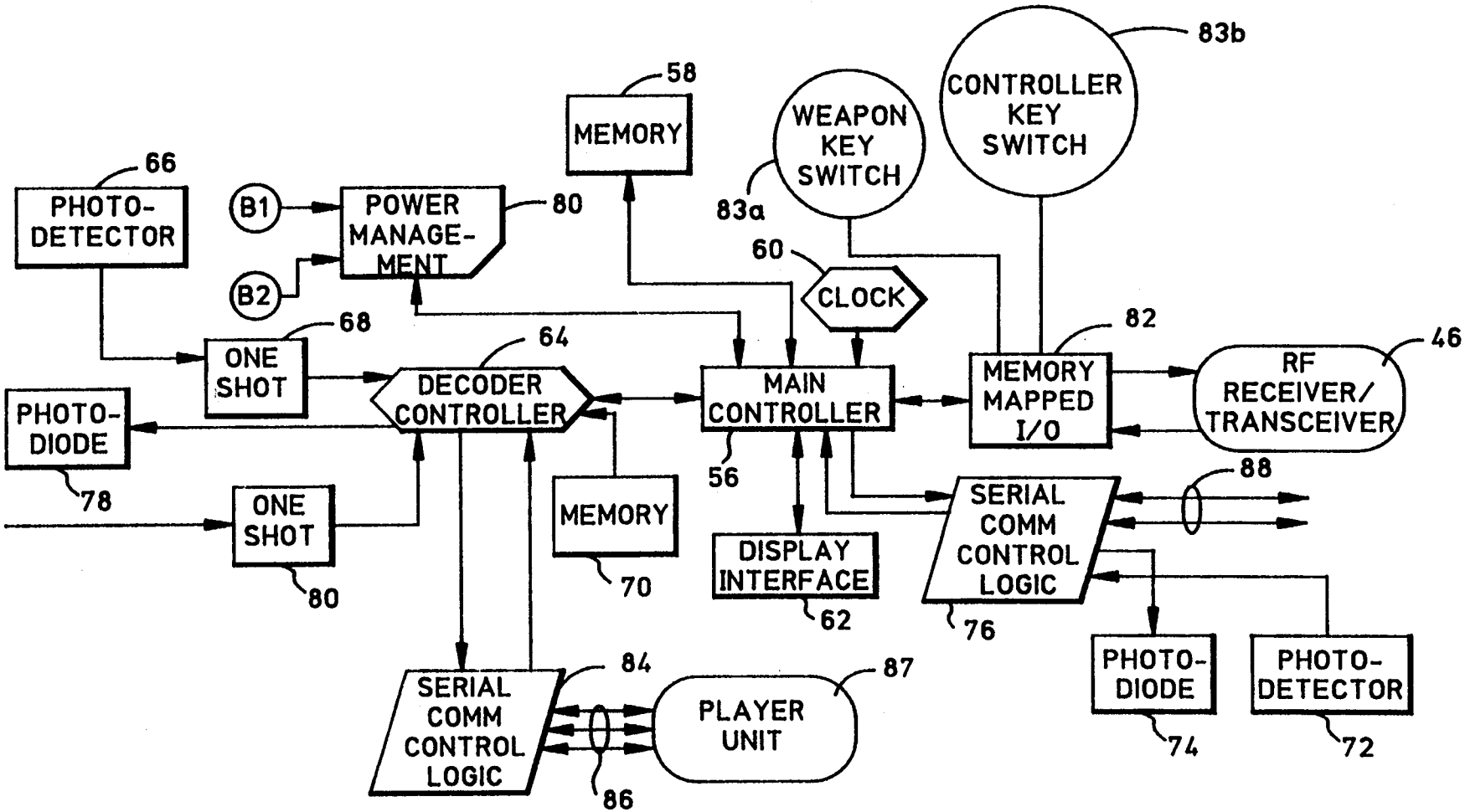
FIG. 4 is a block diagram of the controller illustrated in FIG. 3.

FIG. 4 is a block diagram of the controller illustrated in FIG. 3. It includes a main controller 56 which may be a 87C528 microprocessor. The main controller 56 executes a control program stored in a memory 58 which may be built into the microprocessor. A clock 60 provides real time information to the main controller 56. The main controller 56 is connected to the LCD display 26 (FIG. 3) via a conventional display interface 62 (FIG. 4). The main controller 56 communicates with a decoder controller 64 which receives a signal from an infrared photodetector 66 coupled through a one shot 68. The photodetector 66 is part of the second optical coupling 22 (FIG. 1) and is juxtaposed with the IR LED 42 (FIG. 2) of the first optical coupling 16 when the optical couplings 16 and 22 are physically mated. The decoder controller 64 extracts the MILES code from the electrical signal from the photodetector 66 utilizing a decode program stored in a memory 70.

A photodetector 72 (FIG. 4) and a photo diode 74 are connected through a serial communication control logic circuit 76 to the main controller 56. The photodetector 72 and photo diode 74 provide a third optical coupling for allowing data to be downloaded from the main controller 56 to an external computer. The decoder controller 64 can transmit a MILES bit through a photodiode 78 which forms a part of the second optical coupling 22. The photodiode 78 is juxtaposed with the photodetector 44 of the first optical coupling 16 when the first and second optical couplings 16 and 22 are mated. This allows the amplifier circuit of the amplifier assembly 14 to be tested.

Another signal input representing mines is conveyed through a second one shot 80 (FIG. 4) to the decoder controller 64. The main controller 56 communicates with a memory mapped input/output circuit 82 in order to program the operational frequency of the RF receiver/transmitter 46. The main controller 56 also communicates with a weapon key switch 83*a* and a controller key switch 83*b* through the memory mapped input/output circuit 82. When the player receives a laser "hit" his or her system energizes an audio buzzer which can be turned off by removing a weapon key from his or her SAT and turning off the weapon key switch 83*a*. A controller key is used to resurrect the life of the "killed" player and is only available to a commander.

A serial communication logic circuit 84 (FIG. 4) is connected to the decoder controller for allowing serial communications along a serial data bus 86 to a GPS instrumented player unit 87. The main controller 56 can exchange data with an external computer through the serial communication logic circuit 76, either through the photodetector 72 and photodiode 74 or through a hard wired serial communications bus 88.

The controller 24 (FIG. 3) further includes a power management circuit 80 (FIG. 4) which is connected to a main battery B1 and a backup battery B2. The power management circuit 90 provides power to all of the components of the electronics assembly 20. The main controller 56 monitors the power management circuit for a low battery signal, for a shutdown signal, for a reset signal and for other conditions.

Figure 5:
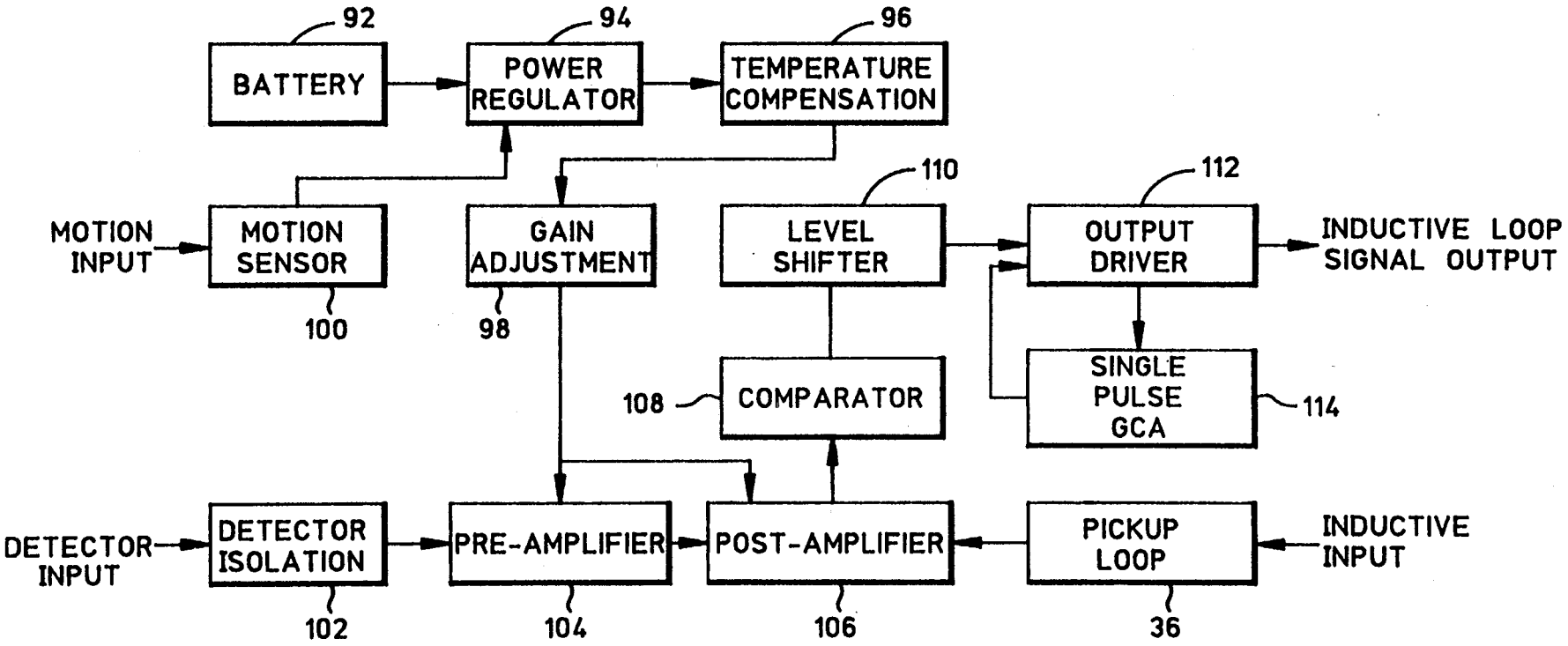
FIG. 5 is a block diagram of the amplifier illustrated in FIGS. 1 and 2.

FIG. 5 is a block diagram of the circuit of the amplifier assembly 14 which is mounted on the harness 12. The battery B1 is represented by the box 92. The battery B1 provides power through a power regulator 94 and a temperature compensation circuit 96 to a gain adjustment circuit 98. A motion sensor circuit 100 is connected to the power regulator 94 in order to turn battery power off a predetermined time duration after the person has not moved. The laser detectors 10 are connected to a detector isolation circuit 102 whose output is fed to a pre-amplifier circuit 104. The gain of the pre-amplifier circuit 104 is controlled by the gain adjustment circuit 98. The output of the pre-amplifier circuit 104 is fed to a post amplifier circuit 106 whose gain is also controlled by the gain adjustment circuit 98. The output of the inductive pickup loop 36 is also fed to the post-amplifier circuit 106. The output of the post-amplifier circuit 106 is fed to a comparator circuit 108 which compares the signal output with a pre-set threshold in order to determine that rite signal is a valid signal and not background noise. The output of the comparator circuit 108 is fed to a level shifter 110 which feeds an output driver circuit 112 to drive the inductive, loop 36. The output of the output driver circuit 112 feeds a single pulse gain control circuit 114 which prevents self-oscillating. The output of the circuit 114 is coupled back to the output driver circuit 112. The output of the post-amplifier circuit is used to drive the photodiode 42 of the first optical coupling 16.

According to our invention, the amplifier 14 of the detection system has been moved outside the normal electronics housing. The amplifier circuit of the amplifier assembly 14 is connected to the controller 24 of the electronics assembly 20 using an IR optical coupling. This protects the high gain amplifier of the assembly 14 from the electrical noise within the housing of the electronics assembly 20. This also enables an independent upgrade of the detection system without having to replace the entire system.

The optical coupling 16 (FIG. 2) enables the electronics assembly 20 (FIG. 1) to perform an on-line test of the circuit of the amplifier assembly 14. The electronics assembly 20 transmits an encoded signal on one channel to the amplifier circuit of the assembly 14 through the optical coupling 16 and checks the integrity of the signal echoed back by the amplifier. The laser signal received by the detectors 10, amplified by the amplifier assembly 14, and communicated through the first and second optical couplings 16 and 22 is decoded by the controller 24 utilizing the special decoder controller 64. This decoder utilizes a software algorithm stored in the memory 70, as opposed to a hardware shift register used in the conventional manworn portion of the MILES. This utilization of a software decoding algorithm enables the use of time diversity analysis to improve the decoding, by compensating for lost information in the laser signal. The software decoding also enables changes and/or modifications of the code structure encoded on the SAT laser, without making modifications to the manworn laser detection system.

While we have described a preferred embodiment of our player identification manworn laser detection system, it should be apparent to those skilled in the art that our invention may be modified in both arrangement and detail. Therefore, the protection afforded our invention should only be limited in accordance with the scope of the following claims.

We claim:

1. A manworn laser detection system for use in a multiple integrated laser engagement system, comprising:

a plurality of laser detectors providing a combined electrical output signal;

a harness adapted to be worn by a person for carrying the plurality of laser detectors;

an amplifier connected to the laser detectors for amplifying the combined electrical output signal of the laser detectors;

a first optical coupling connected to the amplifier for emitting optical signals representative of the amplified combined electrical output signal of the laser detectors; and an electronics assembly electrically isolated from the amplifier and adapted to be carried by the person including a second optical coupling adapted to be mated with the first optical coupling for receiving the optical signals and generating a second electrical output signal representative thereof, a controller for decoding the second electrical output signal, and means for providing an indication to the person of the decoded output signal.

2. A manworn laser detection system for use in a multiple integrated laser engagement system according to claim 1, and further comprising an inductive loop pickup mounted to the harness for inductively receiving a third electrical output signal of an inductive loop transmitter connected to a second plurality of laser detectors mounted to a helmet worn by a person.

3. A manworn laser detection system for use in a multiple integrated laser engagement system according to claim 1 wherein the means for providing the indication to the user of the decoded output signal includes a display.

4. A manworn laser detection system for use in a multiple integrated laser engagement system according to claim 1 wherein the electronics assembly includes an RF receiver/transceiver connected to the controller.

5. A manworn laser detection system for use in a multiple integrated laser engagement system according to claim 1 wherein the electronics assembly includes a GPS receiver connected to the controller.

6. A manworn laser detection system for use in a multiple integrated laser engagement system according to claim 1 wherein the first optical coupling includes an IR emitting diode.

7. A manworn laser detection system for use in a multiple integrated laser engagement system according to claim 6 wherein the second optical coupling includes an IR detector adapted to be juxtaposed with the IR emitting diode.

8. A manworn laser detection system for use in a multiple integrated laser engagement system according to claim 1 wherein the electronics assembly further includes third optical coupling for downloading data from the controller to an external computer.

9. A manworn laser detection system for use in a multiple integrated laser engagement system according to claim 1 wherein the controller includes a main controller and a decoder controller for decoding a MILES code embedded in the second electrical output signal.

10. A manworn laser detection system for use in a multiple integrated laser engagement system according to claim 8 wherein the electronics assembly further includes a serial communication logic circuit connecting the controller and the third optical coupling for exchanging data between the external computer and the controller.

11. A manworn laser detection system for use in a multiple integrated laser engagement system, comprising:

a plurality of laser detectors providing a combined electrical output signal;

an amplifier connected to the laser detectors for amplifying the combined electrical output signal of the laser detectors;

a first optical coupling connected to the amplifier for emitting optical signals representative of the amplified combined electrical output signal of the laser detectors; and an electronics assembly adapted to be carried by the person including a second optical coupling adapted to be mated with the first optical coupling for receiving the optical signals and generating a second electrical output signal representative thereof, a controller for decoding a MILES code embedded in the second electrical output signal, and means for providing an indication to the person of the decoded MILES code.

12. A manworn laser detection system for use in a multiple integrated laser engagement system according to claim 11 wherein the amplifier includes a motion sensor which turns off a source of battery power after a predetermined duration of time in which a person wearing the laser detectors has not moved.

13. A manworn laser detection system for use in a multiple integrated laser engagement system according to claim 11 wherein the amplifier includes a detector isolation circuit connected between the amplifier and the plurality of laser detectors.

14. A manworn laser detection system for use in a multiple integrated laser engagement system according to claim 11 wherein the amplifier includes a preamplifier circuit having an output signal connected to an input of a post-amplifier circuit.

15. A manworn laser detection system for use in a multiple integrated laser engagement system according to claim 14 wherein the amplifier further includes a gain adjustment circuit for controlling a first gain of the pro-amplifier circuit and a second gain of the post-amplifier circuit.

16. A manworn laser detection system for use in a multiple integrated laser engagement system according to claim 15 and further comprising a temperature compensation circuit connected to the gain adjustment circuit for permitting variations in the control of the first gain and the second gain in response to temperature fluctuations.

17. A manworn laser detection system for use in a multiple integrated laser engagement system according to claim 11 wherein the amplifier includes a power regulator circuit.

18. A manworn laser detection system for use in a multiple integrated laser engagement system according to claim 11 wherein the amplifier includes an amplifier circuit and a housing for enclosing the amplifier circuit physically separated from the electronics assembly.

19. A manworn laser detection system for use in a multiple integrated laser engagement system according to claim 18 wherein the housing of the amplifier is physically connected to a harness adapted to be worn by a person, the harness having the plurality of laser detectors physically secured thereto and electrically connected to the circuit of the amplifier.

20. A manworn laser detection system for use in a multiple integrated laser engagement system, comprising:

a plurality of laser detectors to provide a combined electrical output signal;

a harness adapted to be worn by a person for carrying the plurality of laser detectors;

an amplifier connected to the laser detectors including a first housing connected to the harness, the housing enclosing an amplifier circuit connected to the plurality of laser detectors for amplifying the combined electrical output signal of the laser detectors;

a first optical coupling connected to the amplifier for emitting optical signals representative of the amplified combined electrical output signal of the laser detectors; and an electronics assembly including a second housing physically separated from the first housing of the amplifier and adapted to be carried by the person, the electronics assembly further including a second optical coupling adapted to be mated with the first optical coupling for receiving the optical signals and generating a second electrical output signal representative thereof, a controller for decoding a MILES code embedded in the second electrical output signal, a display for providing a visual indication to the person of the decoded MILES code, a third optical coupling for downloading data from the controller to an external computer, an RF receiver/transceiver connected to the controller, and a GPS receiver connected to the controller.

* * * * *